United States Patent [19]

Carino

[11] 4,047,790

[45] Sept. 13, 1977

[54] INSULATIVE HEADER ASSEMBLY WITH FEED THROUGH TERMINALS

[75] Inventor: John W. Carino, Columbia, S.C.

[73] Assignee: General Electric Company, Hudson Falls, N.Y.

[21] Appl. No.: 647,094

[22] Filed: Jan. 7, 1976

[51] Int. Cl.[2] ..... H01R 9/16; H01G 9/10; H01G 1/153

[52] U.S. Cl. ..... 339/220 C; 29/630 D; 174/52 S; 174/152 R; 361/433; 429/181

[58] Field of Search ..... 174/52 S, 151, 152 R, 174/153 R; 317/230; 29/570, 630 D; 339/214 R, 214 C, 218 C, 220 R, 220 C, 220 L, 220 T, 221 R, 221 M, 276 C; 429/175, 178, 179, 180, 181, 182

[56] References Cited

U.S. PATENT DOCUMENTS

| | | | |
|---|---|---|---|
| 1,251,452 | 12/1917 | Noble et al. | 429/181 |
| 1,702,158 | 2/1929 | Gagnon | 339/220 T |
| 1,806,815 | 5/1931 | Muther | 339/220 T |
| 3,978,377 | 8/1976 | Constanti | 317/230 |

*Primary Examiner*—Laramie E. Askin
*Attorney, Agent, or Firm*—James J. Lichiello

[57] ABSTRACT

Disclosed is an insulative header assembly with electrical feed through terminals therein. The header includes at least one tapered opening therethrough. A depression or counterbore at the narrow end of the tapered opening forms a shoulder therewith. A metallic one-piece feedthrough terminal with a tapered portion is forced into the tapered opening tightly enough to form a seal therewith. Part of the tapered portion extends into the recess or depression. The metal in the depression is flared to overlap the shoulder and thus securely fix the terminal in place. There are splines in the depression, and the metal that is forced into the depression conforms to the shape of the splines and thus rotatably restrains the terminal in the header.

24 Claims, 12 Drawing Figures

PRIOR ART FIG.1.
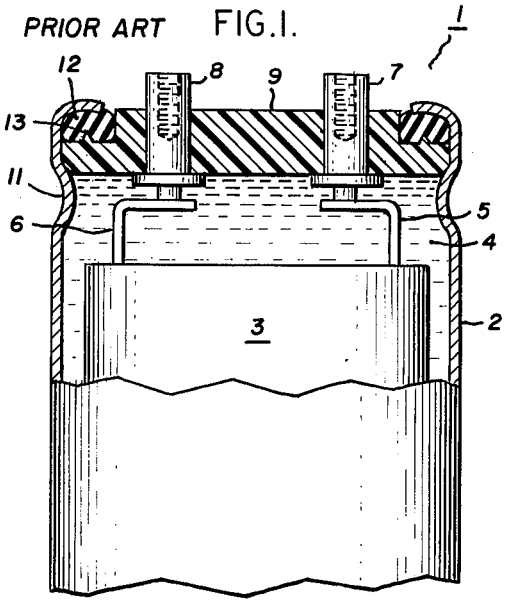
FIG.2.
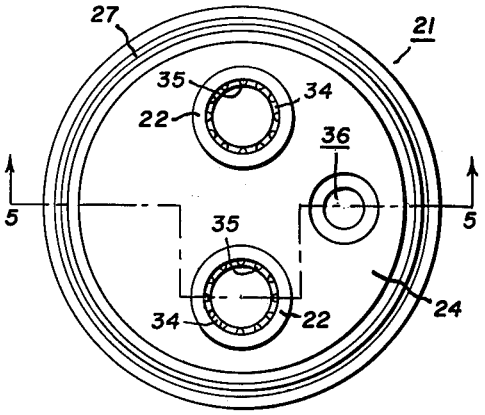
FIG.3.
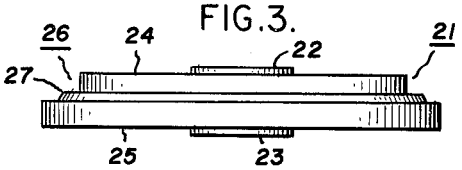
FIG.6.
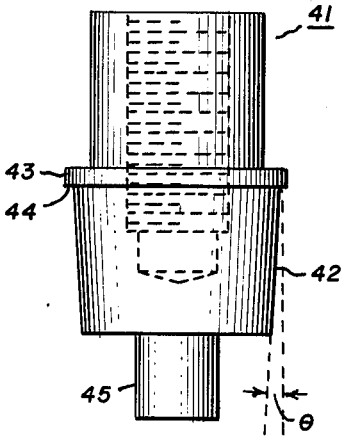
FIG.4.
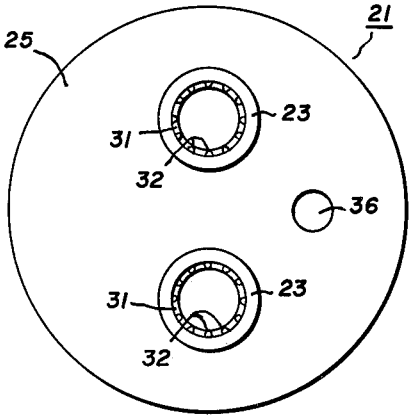
FIG.5.
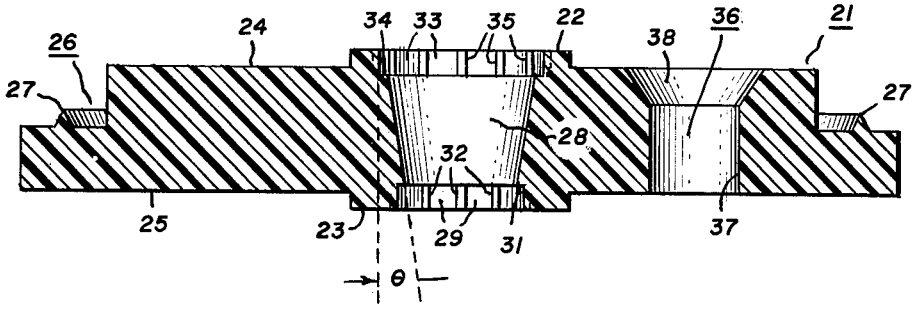

INSULATIVE HEADER ASSEMBLY WITH FEED THROUGH TERMINALS

BACKGROUND OF THE INVENTION

This invention relates to headers with electrical feed throughs therein and, more particularly, to such header and feed through assemblies as are useful in electronic components such as electrolytic capacitor housings.

In the electronics industry there are many uses for electrically insulating headers with metallic feed through terminals therein. Many of these uses relate to component housings which must supply mechanical protection and electrical isolation. The feed through terminal facilitates electrical connection to the device. One common example of such a header with feed through terminals is the plastic cap used on computer grade electrolytic capacitor cans.

In the past, such headers have generally been manufactured by one of two methods. According to the most common technique, a single molding step forms the header around the metal feed through terminals and imparts to the plastic header its overall shape. Thus, final assembly requires but one molding step. A disadvantage of this technique is that most of the material cost of the finished assembly is in the metal terminals. If the molded plastic header is found to to defective, the costly terminals are, as a practical matter, irretrievably fixed therein and are thus usually discarded with the defective header.

The second common prior art technique also beings with molding plastic headers. However, the terminals are not molded in place, rather, oversized openings are formed during molding and the terminals are later inserted therein. The excess space in the openings is filled with a material which both seals the openings and firmly fixes the terminals in place. For example, an epoxy material can be used. This method was an improvement over the aforementioned method in that the loss of higher cost metallic terminals was reduced. However, it did not provide a complete solution to the problem because the manufacturing process was more costly as it was substantially complicated and lengthened due to the requirement of additional material and steps.

It is, therefore, a principal object of this invention to provide an improved insulative header assembly with metallic lead through terminals therein; also, to provide a method for the manufacture of the header which overcomes the stated problems of the prior art.

SUMMARY OF THE INVENTION

Disclosed is a header assembly having at least one feed through terminal suitable for applications such as computer grade electrolytic capacitor cans. The header assembly is manufactured by the following process. First, a disc-like header of insulating material is provided. The header is defined by two substantially parallel surfaces and has passing transversely therethrough at least one slightly tapered opening. In the wall surface of the opening, adjacent the narrow end of the opening, is a depression which, in conjunction with the opening, forms an annular shoulder having a circumferential series of splines therein. A one-piece metal feed through terminal with a tapered portion is pressed in nesting relationship into the tapered opening tightly enough to form a seal therewith. At least part of the terminal extends into the depression, and at least a portion of the part of the terminal which is in the depression is then forcibly flared so that it overlaps the shoulder and conforms with the splines. The overlapping secures the terminal in the opening and prevents its withdrawal. Inasmuch as the flared portion conforms with the splines, the terminal is also rotatably secured. A header assembly manufactured in this manner overcomes many of the deficiencies of the prior art inasmuch as no additional materials (such as epoxies) are required yet assembly is still fast and easy. Furthermore, the metal terminal is not attached to the header until after the header member has completed its manufacture, and thus no metal terminals are lost because they are otherwise locked in imperfect header members.

Preferably, the header member is formed of a relatively hard plastic material, such as a phenolic material, and the metal terminal is formed of a metal which is relatively ductile. Specifically, the metal terminal must be formed of a metal which is softer than the chosen plastic. Aluminum and its alloys are preferred, and a relatively high purity aluminum is most preferred. In addition to ductility, high purity aluminum has the additional advantage of exhibiting a very low electrical resistivity.

The tapered portion of the metal terminal and the taper of the opening wall are essentially equal and of a relatively shallow angle, such as below ten degrees. Preferably, the tapers are between about two and three degrees. When such a shallow taper is present and the terminal is forced into the opening, the aluminum also conforms to the shape of any irregularities in the opening, thus enhancing the seal. Additionally, the tapered portion on the terminal is preferably slightly oversized as compared to the opening. Typically, the tapered portion of the terminal is oversize by no more than about two mils in diameter. With such an oversized tapered portion, the aluminum around the entire surface of the tapered portion is forced to yield in varying degrees to the plastic and thus sealing is further enhanced.

It is preferable that the tapered opening and the tapered portion define truncated cones having a generally circular cross section, although a corrugated circular cross section or one approximating an octahedra may be equivalent. Such a shape simplifies assembly inasmuch as there is no rotational orientation required during the step of inserting the terminals into the opening. An irregularly shaped opening, such as a square or rectangular opening, might obviate the need for splines, but corners in the opening provide potential paths for leaks through the header.

It is preferable that a second annular depression be formed in the surface adjacent the large end of the tapered opening and that the terminal be provided with a step or rib at the large end of the tapered portion that nests in the depression when the terminal is forced into place. This second depression and step, or rib, provide additional sealing integrity. Furthermore, splines are also preferably included in the second depression to enhance the rotation resistance of the finished assembly.

DESCRIPTION OF THE DRAWINGS

These and other features and objects of the present invention will become more apparent upon a perusal of the following description taken in conjunction with the accompanying drawings wherein:

FIG. 1 is a sectional elevation view of a prior art electrolytic capacitor;

FIG. 2 is a plan view of the top of a header member made in accordance with the teachings herein;

FIG. 3 is an elevation view of the header member depicted in FIG. 2;

FIG. 4 is a plan view of the lower surface of the member depicted in FIGS. 2 and 3;

FIG. 5 is a sectional elevation view, taken along the line 5—5 in FIG. 2, of the header member fabricated in accordance with the teachings herein;

FIG. 6 is an elevation view of a metal terminal designed to be used in conjunction with the header member depicted above;

DESCRIPTION OF THE PREFERRED EMBODIMENTS

Figure 7:
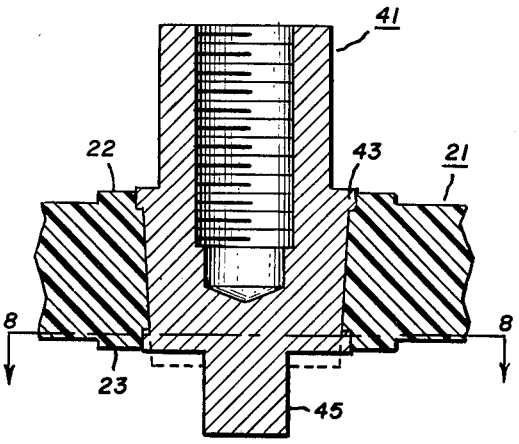
FIG. 7 is a sectional view of the terminal inserted in the header member in accordance with the teachings herein.

Referring now to FIG. 1, there is shown a prior art electrolytic capacitor 1 comprising a cup-shaped casing 2 preferably made of a metal such as aluminum and containing a rolled or other capacitor section 3 conventionally made of a pair of convolutely wound, filmforming metal electrode foils separated by paper or other dielectric spacer material, and a liquid electrolyte 4 which fills the casing and impregnates the capacitor section 3. The electrolyte 4 may be any conventional or known type of capacitor electrolyte, as, for example, an aqueous ammonium pentaborate-glycol solution and it may be in liquid, gel, paste or other form.

Two leads 5 and 6 are connected to the respective foils and extend outwardly from the end toward the opening of the casing 2, the terminals and the foils to which they are respectively connected having opposite polarity in the operation of the capacitor unit. Leads 5 and 6 may be of filmforming metal and may be welded to feed through terminals 7 and 8 which are fixed in a header member 9. In a usual construction, casing 2 is cup-shaped with one open end sealed by a header assembly as described below. While the header assembly 10 comprising header 9 and terminals 7 and 8 is shown and described for only one end of the capacitor casing, it will be understood that if the casing is tubular with both ends open, the opposite open end may have the same type of header assembly therein.

It should also be understood that the described header assembly can be employed in types of capacitors other than those shown. For example, the casing 2 could contain an anode of suitable type (such as a sintered slug or wound foil anode) inserted therein instead of the capacitor section 3, the casing serving as the cathode and having a terminal soldered to its bottom end, all as is well known in the art. The header assembly may also be used in nonpolar capacitors, and in fact, in assemblies unrelated to the capacitor art.

Header member 9 which supports the two feed through terminals 7 and 8 is used to seal the open end of the casing 2. As shown in FIG. 1, the upper end of the casing 2 is rolled inwardly. However, initially, on the upper end of the casing 2 is a shoulder 11 which is formed by a depression in the casing wall. Header 9 is placed in the casing and its downward motion is limited by the shoulder 11. The periphery of the header 9 contains a recess or lip, and a sealing member, such as a rubber O-ring 12, is placed in the recess within the casing 2. The upper end of the casing is then rolled over the sealing member 12 in a manner well known in the prior art. The rolled upper end of the casing presses the sealing member and the header against the shoulder 11 and thus tightly seals the capacitor. The seal can be improved if a relatively sharp sealing projection 13 extends around the header and intersects the sealing member 12. All of this is well known in the prior art.

In the following description of the improved header assembly and its construction, no further detailed discussion concerning capacitor fabrication is included because the improved header assembly functions as a direct replacement for the header 9 of the prior art. Also, it should be clearly understood that the subject invention is not limited in its application to capacitors.

Referring now to FIGS. 2, 3, and 4, there are shown upper plan, elevation and lower plan views, respectively, of an improved header member 21 which is preferably an insulating material such as a plastic and, most preferably, a relatively hard plastic such as phenolic. The member 21 defines two substantially parallel surfaces 22 and 23 which may be integral with its major substantially parallel surfaces 24 and 25, or may be spaced therefrom as shown in FIG. 3. As is seen most clearly in FIGS. 2 and 4, there are two surfaces 22 and two surfaces 23. It will readily be appreciated that the header 21 can be fashioned to accommodate one or more than one feed-through terminal in accordance with the desired end use by providing additional raised surfaces. Furthermore, each terminal can be associated with separate, raised surfaces which are offset from the major surfaces 24 and 25 as shown, or the terminals can be associated directly with the major surfaces, or several terminals can share a single set of offset raised surfaces.

As shown most clearly in FIGS. 2 and 3, a notch or lip 26 extends around the upper periphery, and sealing projection 27 is included therein so that the header 21 can be mounted in a capacitor casing in a manner similar to that of header 9 depicted in FIG. 1. It will be appreciated that if the header and feed through assembly to be described are not destined for use in a capacitor, the peripheral portion thereof can be modified as desired to facilitate the ultimate mounting process to be used. Furthermore, it will be appreciated that, depending upon the ultimate use of the header 21, it need not be circular.

The header is shown in more detail in FIG. 5 which is best taken in conjunction with FIGS. 2 and 4. A slightly tapered opening 28 extends from the surface 22 to the surface 23. The taper is gradual and thus the angle $\theta$ is preferably less than about 10° and in one form of this invention is approximately $2\frac{1}{2}$°. The taper is shown somewhat exaggerated in FIG. 5 (and in subsequent FIGS.) for clarity. A first depression 29 in the surface 23 (near the narrow end of the tapered opening 28) intersects the opening and defines a shoulder 31 therewith. Furthermore, the depression defines splines 32, which are best shown in FIG. 4. Preferably, a second depression 33 is in the surface 22 which similarly forms a second shoulder 34 with the large end of the tapered opening 28. In addition, the depression 33 preferably defined splines 35 best seen in FIG. 2.

As evident from FIGS. 2 and 4, when the tapered opening 28 is observed vertically, it appears circular. Thus, the opening 28 between the depressions 33 and 29 is in the form of a truncated cone.

Continuing with the example of an electrolytic capacitor header, a vent opening 36 is included in header 21 and it comprises a straight portion 37 and a tapered portion 38 as is well known in the prior art. The vent opening is filled with a conventional elastomeric material.

Referring now to FIG. 6, there is shown an elevation view of a one-piece metal feed-through terminal 41 which is made of a metal which is softer than the plastic used to form the header 21. Preferably, the terminal 41 is made of aluminum and, most preferably, of a relatively high purity aluminum such as commercially available 99.88 percent pure aluminum. The terminal has a tapered portion 42 which is in the shape of a truncated cone and will ultimately be pressed into the tapered opening 28 of FIG. 5 as will be described below. The tapered portion 42 defines a relatively shallow taper similar to the tapered opening 28, and thus the angle $\theta$ also is preferably less than about ten degrees, and in one embodiment of the invention is about two and one-half degrees. At the large end of the tapered portion 42 is a peripheral bead or shoulder 43 which in conjunction with the tapered portion defines a step 44.

As shown in FIG. 6 and is common in the prior art, a threaded opening extends into the terminal 41 to facilitate connection thereto. Furthermore, a connecting lug 45 is attached to the lower end of the tapered portion 42 to connect to the capacitor leads 5 and 6 as does the connecting lug in FIG. 1. It will be appreciated, of course, that the connecting lug 45 and the tapped hole can be replaced with any form of connection mechanism which may be chosen for a particular application.

Referring now to FIG. 7, there is shown the feed-through terminal 41 inserted in the header 21. First, the terminal 41 is pressed into the tapered opening to form a seal therebetween. Preferably, the tapered portion of the terminal is slightly larger than the tapered opening, but not so large as to break the header member. For example, it has been found that a configuration with the tapered portion of the terminal between 0 and 2 mils larger than corresponding portions of the opening will provide a good seal. Since the aluminum will be forced to yield slightly at substantially all points of contact with the tapered opening 28 when the terminal is fully inserted into the opening, the shoulder 43 nests in the depression 33 to further improve the seal. Immediately after the terminal is pressed in place, the narrow end of the tapered portion of the terminal extends at least into the depression 29, and, preferably, extends slightly out of the depression 29 past the surface 23, as illustrated in the dashed lines in FIG. 7. The portion of the terminal extending into the depression 29 is shown and called tapered for convenience only. It will be appreciated that the part of the terminal shown by the broken line in FIG. 7 need not be tapered.

The terminal 41 is securely fastened in the header 21 by flaring at least part of the underside of tapered portion of the terminal which is in the depression 29. This forces the soft metal not only to conform to the shape of the depression 29 but also to radially overlap the shoulder 31 therein as shown in FIG. 7. Thus, additional sealing is provided and, furthermore, the terminal becomes permanently affixed to the header 21. Such a flaring of the relatively soft aluminum can be achieved by conventional processes such as orbital riveting. It should be understood that only part of the aluminum, rather than its entire periphery, need be flared to hold the terminal in place. However, it is felt that the seal is improved if the entire periphery is flared as shown in FIGS. 7 and 8.

Since the aluminum is substantially softer than the phenolic, the shoulder 43 conforms to the splines 35 when it is forced into the depression 33. Similarly, during the flaring process, the aluminum that is forced over the shoulder 31 into the depression 29 conforms to the splines 32 as is best shown in FIG. 8. Thus, it will be appreciated that the terminal 41 is prevented from rotating within the header 21.

It will be understood that, although the insertion of only one terminal has been described, most capacitor headers will have two or more identical terminals.

Figure 8:
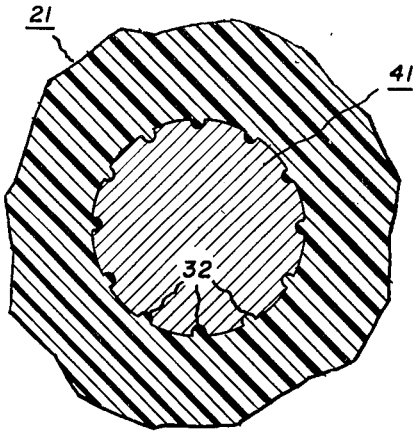
FIG. 8 is a sectional plan view, taken along the line 8—8 in FIG. 7, through the terminal after it has been inserted in the header member as depicted in FIG. 7.

In FIG. 8, the splines are depicted as essentially semicircular which is believed to be the easiest shape to manufacture. However, it should be appreciated that the splines could be another shape, such as triangular or rectangular, if desired.

Figure 9:
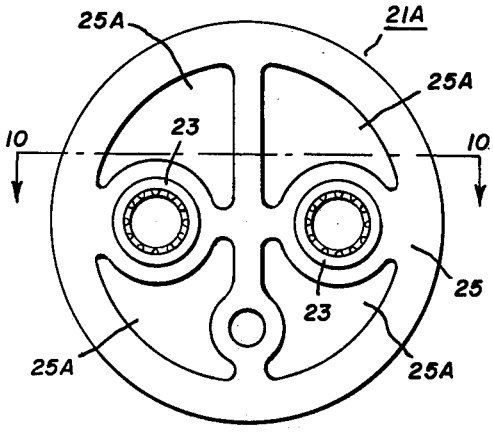
FIG. 9 is a plan view of an alternate header member embodiment.
Figure 10:
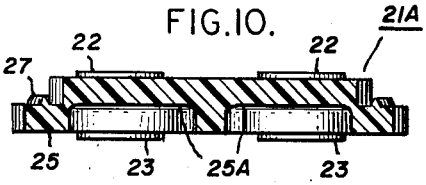
FIG. 10 is a sectional elevation view, taken along the line 10—10 in FIG. 9, of the alternate embodiment of FIG. 9.

Referring now to FIGS. 9 and 10, there is shown an alternate header member 21A, generally similar to the header 21 in that two sets of parallel surfaces 22 and 23 are defined, each having a tapered opening 28 extending therebetween. However, surface 25 of the header member 21A is recessed in several areas 25A thereof. Including such recessed areas is a matter of convenience which saves material and weight. However, the present inventive concept is unaffected and terminal members 41 are inserted into the member 21.

Figure 11:
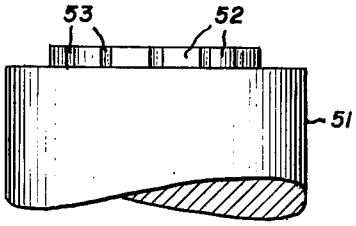
FIGS. 11 and 12 are elevation views of molding inserts which form the tapered openings in the headers.

Referring next to FIG. 11, there is shown a molding insert 51 which includes a projection 52 that defines splines 53. The insert 51 is sized and splined to be utilized in a plastic mold cavity to form the depression 29 and the splines associated therewith.

Figure 12:
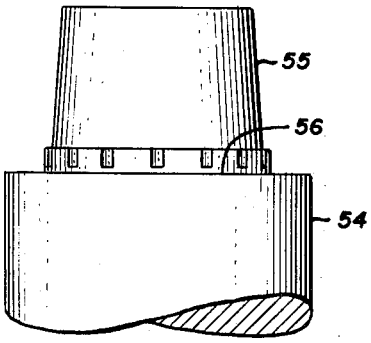

Referring now to FIG. 12, there is shown another mold cavity insert 54 that defines a tapered projection 55 with a splined step 56 at the base thereof. The insert 54 is utilized in a mold cavity in a conventional manner to form the tapered opening 28 and the larger depression 33 and the splines associated therewith.

In practice, the two inserts 51 and 54 are positioned in a mold cavity so that they are abutted and together form the tapered opening and both splined depressions simultaneously, as the header member is being molded.

In view of the foregoing, many modifications and variations of the present invention will be obvious to those skilled in the art. For example, it will be appreciated that the larger splined depression 33 adjacent the surface 22 may be omitted. Its inclusion is preferable as it improves the sealing properties, but it is not necessary. It is to be understood, therefore, that this invention can be practiced otherwise than as specifically described.

What is claimed is:

1. In combination, a header assembly comprising:

a disc-like header made of insulating material and having a slightly tapered opening projecting transversely therethrough, the narrow end of said tapered opening having a depression formed therein and defining a shoulder, said depression including a peripheral row of axial spline means;

a one-piece metal feed through terminal pressed into said opening, said terminal having a tapered portion which is fitted into said tapered opening tightly enough to form a seal therewith, said terminal extending at least into said depression;

said terminal being formed of a material which is softer than the material of said header so that when pressed into said opening said terminal conforms to irregularities in said opening to enhance the seal; and at least a portion of the part of said terminal that is within said depression being flared so that said portion overlaps said shoulder and conforms with said spline means.

2. The combination of claim 1 wherein the tapers of said opening and of said terminal are less than about 10 degrees.

3. The combination of claim 2 wherein the tapers of said opening and of said terminal are about 2½°.

4. The combination of claim 2 wherein said header is plastic and said terminal is aluminum.

5. The combination of claim 4 wherein said aluminum is high purity aluminum.

6. The combination of claim 4 wherein said plastic is phenolic.

7. The combination of claim 4 wherein said tapered portion is about 0 to 2 mils larger than said opening.

8. The combination of claim 7 wherein said opening is in the shape of a truncated cone.

9. The combination of claim 1 wherein said header has a second depression which intersects and forms a second shoulder with the large end of said tapered opening and said terminal comprises a step at the large end of said tapered portion, said step nesting in said second depression when said terminal is pressed into said opening.

10. The combination of claim 9 wherein said second depression defines second peripheral spline means and said step conforms with said second spline means when said terminal is pressed into said opening.

11. The combination of claim 10 wherein the tapers of said opening and of said terminal are less than about 10 degrees.

12. The combination of claim 11 wherein said header is plastic and said terminal is aluminum.

13. The combination of claim 12 wherein said aluminum is high purity aluminum.

14. The combination of claim 13 wherein said opening is in the shape of a truncated cone.

15. A header assembly for capacitors comprising, in combination, a header of insulating material and at least two feed through terminals;

said header defining two substantially parallel surfaces and having at least two slightly tapered openings projecting transversely therethrough, the narrow end of each of said openings terminating at separate depressions in one of said surfaces, each of said depressions forming a shoulder around the associated narrow end and defining peripheral spline means;

a separate one-piece metal feed through terminal pressed into the each of said openings, each of said terminals having a tapered portion which is fitted into the associated tapered opening tightly enough to form a seal therewith, each of said terminals extending at least into the associated depression;

each of said terminals being formed of a material which is softer than the material of said header so that when pressed into the associated opening each of said terminals conforms to irregularities in said opening to enhance the seal; and at least a portion of the part of each terminal that is within the associated depression being flared so that said portion overlaps the associated shoulder and conforms with said spline means.

16. The combination of claim 15 wherein the tapers of said openings and of said terminals are less than about ten degrees.

17. The combination of claim 16 wherein the tapers of said openings and of said terminals are about 2½°.

18. The combination of claim 16 wherein said header is plastic and said terminals are aluminum.

19. The combination of claim 15 wherein said header defines two second depressions each of which intersects and forms a second shoulder with the large end of a corresponding one of said tapered openings, and each of said terminals comprising a step at the large end of a corresponding one of said tapered portions, each of said steps nesting in a corresponding one of said second depressions when said terminals are pressed into said openings.

20. The combination of claim 19 wherein said second depressions define second peripheral spline means and said steps conform with said second spline means when said terminals are pressed into said openings.

21. The combination of claim 20 wherein the tapers of said openings and of said terminals are less than about ten degrees.

22. The combination of claim 21 wherein said header is plastic and said terminals are aluminum.

23. The combination of claim 22 wherein said aluminum is high purity aluminum.

24. The combination of claim 23 wherein said openings are in the shape of truncated cones.

* * * * *